United States Patent [19]

Belli

[11] Patent Number: 4,979,422

[45] Date of Patent: Dec. 25, 1990

[54] HOLOGRAPHIC DRUMHEAD

[76] Inventor: Remo D. Belli, 12804 Raymer St., North Hollywood, Calif. 91605

[21] Appl. No.: 538,415

[22] Filed: Jun. 15, 1990

[51] Int. Cl.[5] ..... G10D 13/02

[52] U.S. Cl. ..... 84/414

[58] Field of Search ..... 84/411–420

[56] References Cited

U.S. PATENT DOCUMENTS

| | | | |
|---|---|---|---|
| 2,667,098 | 1/1954 | McMullen | 84/414 |
| 4,145,945 | 3/1979 | Iyeta | 84/1.18 |
| 4,282,793 | 8/1981 | Muchnick | 84/414 |
| 4,706,540 | 11/1987 | Donohoe | 84/414 |
| 4,809,582 | 3/1989 | Chang | 84/414 |
| 4,860,624 | 8/1989 | Dinnan et al. | 84/454 |

*Primary Examiner*—Lawrence R. Franklin

*Attorney, Agent, or Firm*—Rapkin, Gitlin, Moser & Schwartz

[57] ABSTRACT

The present invention provide for a drumhead, or the head of any percussion or related instrument, such as a tambourine, which includes a layer in which a hologram image is formed which incorporates a thin metal coating conforming substantially to the contours of the hologram, and a dark colored synthetic substrate, to which the bottom surface of the layer of film incorporating the hologram is laminated. The thin metal coating, often aluminum as the metal alloy of choice, is applied utilizing a process commonly known in the art as "metalizing", wherein the molecules of the metal are dispersed relatively evenly over a given surface by the decomposition of the metal in its gaseous form. The coating is deposited to a thickness that allows approximately 65% light transmission through the hologram forming film layer and enables the dark colored substrate beneath to enhance the dramatic and colorful light effects ultimately achieved by the invention.

10 Claims, 1 Drawing Sheet

HOLOGRAPHIC DRUMHEAD

FIELD OF INVENTION

The present invention relates generally to the area of drumhead construction and, more particularly, to a head for a drum and related percussion instruments that includes a laminate comprising a hologram effect enhancing substrate and a hologram forming layer, which embodies a hologram coated with a thin metal alloy film.

DESCRIPTION OF THE PRIOR ART

Though holograms are not new in the art, their uses and methods of application relative to the heads of drums and related percussion instruments, such as tambourines, are more limited. Improved drumhead construction to achieve a better tonal quality and a more resilient and longer lasting product are objectives continually sought after in the drumhead art. However, like so many other products of a musical nature, the aesthetic appearance of an instrument is often equally or, at the very least, nearly as important as the quality of the instrument relative to a successful sales and marketing effort. For example, the shell or drum body portion of a drum has, for many years, been the object of an effort to "dress up" the product to make it more attractive to the potential buyer and musician. For the most part, until recently, the drumhead has not been a main target of this effort for a variety of reasons, though most principally because the decorations or graphics applied to the head of the drum, whether in the form of a decal, paint or any other conventional application, quickly peels or wears off as a result of the pounding and rubbing to which drumheads, tambourine heads and the like are constantly subjected. The worn and deteriorated look that results naturally detracts from the over all aesthetic appearance of the instrument and ultimately the value of the product.

Efforts to utilize holographic effects on drumheads and similar types of percussion instruments, such as tambourines, are relatively new and have produced a wide variety of results. Certain types of drums are marketed to a segment of the buying public which demands a more sophisticated and dramatic look due to their own individual tastes, the types of music they play and possibly the types of venues or environments in which the particular instrument is used.

Some musicians, whether amateur or professional, desire drums or tambourines with heads that are simple in design and basic in color. Others prefer a core dramatic, or "hard" look. Holograms that create unusual designs and shapes and simultaneously break up into unusual light patterns reflecting off its surface are prime examples of the kinds of effects desired by certain individuals. These effects are even more dramatic and the colors much more vibrant and attractive when certain elements are combined to form the drum or tambourine head of the type claimed herein. The first of these elements requires the bottom surface of the hologram forming layer to be laminated to a blackened substrate to enhance the colors reflected from the hologram surface pattern. The second requires the introduction of a thin metal coating on the hologram forming surface which allows approximately 65% light transmission to the substrate beneath.

The coating process, which is sometimes known in the trade as "metalizing", produces a layer of metal alloy which, depending upon its thickness, a critical consideration, can enhance or stifle the degree of translucency and reflectivity relative to the hologram and the film layer in which it is formed. Too little metalizing can create a surface and hologram which are too translucent (almost transparent) and not sufficiently reflective to achieve the desired dramatic light effect enhanced by the substrate beneath. Thicker coatings, which usually take on a silvery or mirror-like appearance, will substantially increase the translucency creating a progressively opaque surface and ultimately stifle the dramatic effect created by the composite elements of the invention.

The prior art, though known to already utilize metal coatings with holograms in conjunction with various types of substrates, does not disclose the specific elements of the present invention that combine to achieve a result not sought after and obtained until now.

Thus, the present invention solves the problems associated with the prior art by successfully merging a dark colored substrate through the process of lamination with a hologram effect forming layer, which has been previously coated with a thin metal layer allowing approximately 65% light transmission to enhance the translucency and reflectivity of the composite elements to produce the desired effect.

SUMMARY OF THE INVENTION

The present invention provides for a drumhead, or the head of any percussion or related instrument, such as a tambourine, which includes a layer in which a hologram image is formed which incorporates a thin metal coating conforming substantially to the contours of the hologram, and a dark colored synthetic substrate, to which the bottom surface of the layer of film incorporating the hologram is laminated. The thin metal coating, often aluminum as the metal alloy of choice, is applied utilizing a process commonly known in the art as "metalizing", wherein the molecules of the metal are dispersed relatively evenly over a given surface by the decomposition of the gaseous form of the metal. The coating is deposited to achieve a thickness that allows approximately 65% light transmission through the hologram forming film layer to enable the dark colored substrate beneath, which is substantially light absorbing, to enhance the dramatic and colorful light effects ultimately achieved by the invention.

Accordingly, an object of the present invention is to provide a head for a drum or related musical instrument that incorporates a hologram on the surface of a film layer and a thin metal coating thereon that enhances the translucency of the film and the reflectivity of light and colors emanating from the surface hologram pattern.

Another object of the present invention is to provide a head for a drum or related musical instrument that includes a hologram forming layer upon which there is deposited a thin metal coating, and a dark colored substrate laminated to the bottom surface of the hologram forming layer to enhance the intensity and colors of the reflected light generated from the hologram surface.

Still another object of the present invention is to provide a head for a drum or related musical instrument that includes a film layer incorporating a hologram, a thin metal coating deposited thereon, and a dark colored substrate laminated thereto which, when used in conjunction with a musical instrument, does not detract from the tonal quality of the instrument.

Still yet another object of the present invention is to provide a head for a drum or related musical instrument that comprises an upper film layer incorporating a hologram image upon its surface, a metal alloy coating applied to substantially conform to the contours of the hologram allowing approximately 65% light transmission therethrough, and a dark colored substrate laminated to the lower surface of the film layer.

Still yet another object of the present invention is to provide a head for a drum or related musical instrument that can easily and efficiently be manufactured.

Other objects and advantages of the present invention will become apparent in the following specifications when considered in light of the attached drawings wherein a preferred embodiment of the invention is illustrated.

A BRIEF DESCRIPTION OF THE DRAWINGS

DETAILED DESCRIPTION OF THE PREFERRED EMBODIMENT

Figure 1:
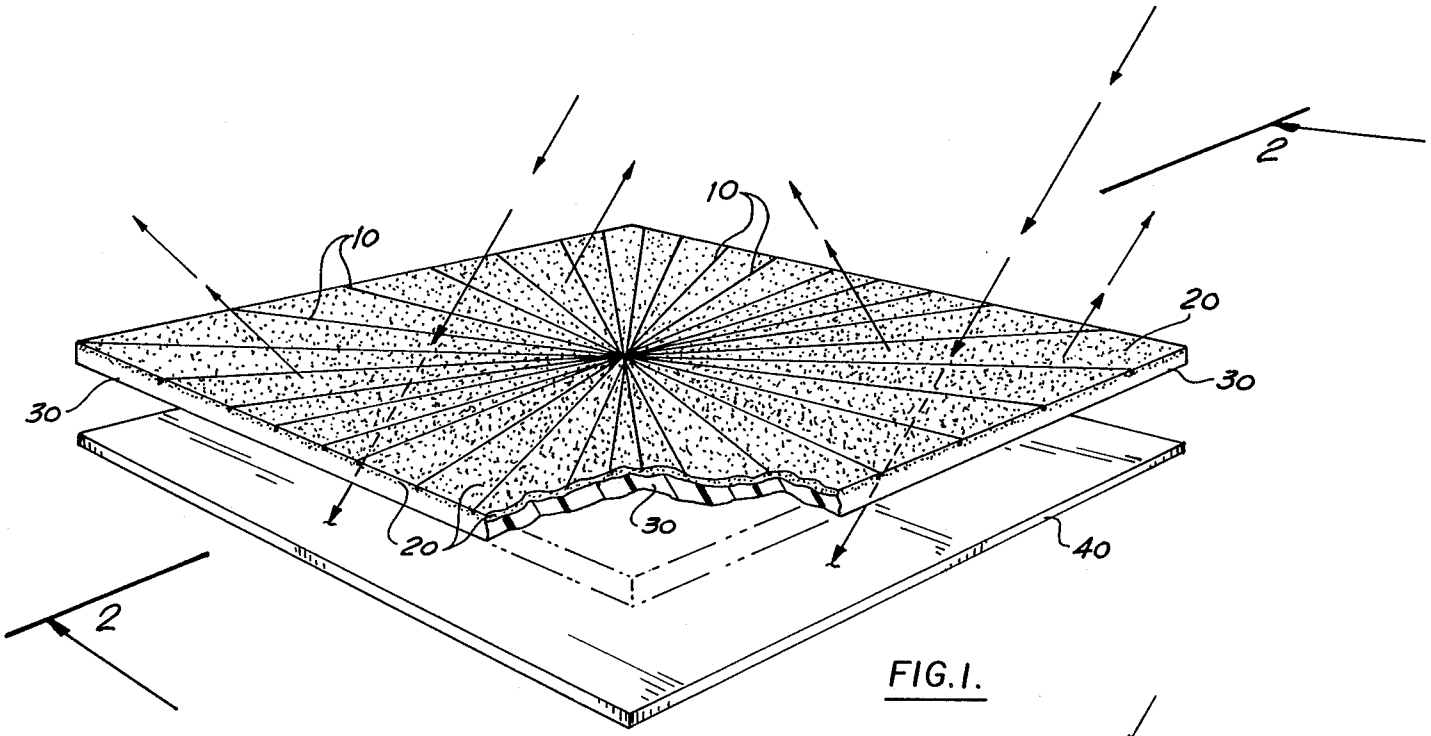
FIG. 1 is a perspective view of the present invention showing the hologram forming layer, including the hologram pattern therein, the thin metal coating deposited upon the hologram surface and the dark colored substrate laminated to the hologram forming layer.
Figure 2:
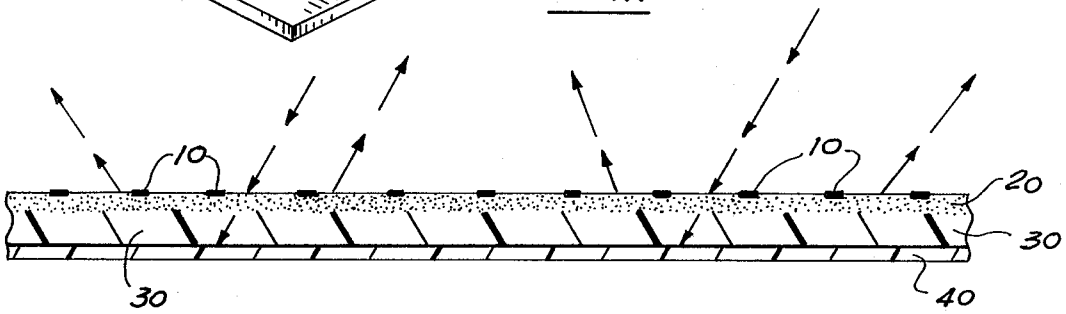
FIG. 2 is a sectional view of the present invention taken along line 2—2 of FIG. 1.

Referring more particularly to the drawings, FIG. 1 is a perspective view of the present invention in its preferred form. Hologram 10 is formed on the surface of a film 30 fabricated of polyester or a similar material. Film 30 is typically transparent, although this is not an absolute requirement. A translucent material may also be an acceptable alternative. Film 30 is preferably 0.002 to . . . 0.003 inches thick, though a lesser or greater thickness may also be suitable. Any known conventional method of forming a hologram upon the surface of film 30 may be utilized, including the embossing process. After the hologram is formed, the surface of the hologram is coated with a thin, seemingly microscopic, layer of metallic particles 20, such as aluminum, which substantially conforms to the contours of the hologram pattern. The metal coating is deposited upon the surface of the hologram pattern using a conventional process which culminates in the explosion of the metal in its gaseous form, showering the surface of the hologram evenly with millions of metallic particles. Coating 20 allows approximately 65% light transmission. Laminated to the bottom surface of the film 30 is a substrate 40, which is fabricated of any suitable synthetic material. Substrate 40 is preferably dark (usually black) in color to enable the enhancement of the light and color intensity emanating from the hologram surface patterns. A substantial portion of the light transmitted to the substrate 40 is absorbed due to the intensely dark color of the material. This normally reduces any potential interference with the light and color reflected from the surface of hologram 10 and maximizes the enhancement capabilities of the substrate relative to the hologram forming film 30.

The purpose of the invention is to combine certain elements to achieve a specific degree of reflectivity of light and an array of color combinations generated from the surface of the hologram 10. The effect sought can only be achieved by a combination of materials that absorb and reflect light beams in the manner taught by the invention. A coating 20, which is too thick or dense, will typically resist light transmission to the surface of substrate 40. Thick coatings, which usually give a mirror-like appearance, will also increase the reflectivity of the light hitting the surface of the hologram 10. This results in the distortion of light and colors, which detracts from the desired aesthetic appearance of the drumhead or tambourine. An improper combination of elements, such as, for example, a substrate that is not dark enough in color and/or a metal coating that is either too thick, too thin or does not substantially conform to the contours of the hologram, can cause the light that refracted is on the surface of the drumhead or tambourine to be either too weak or too strong in intensity. In each case, the result is substantially less than the dramatic and colorful effect sought and achieved by the present invention.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

I claim:

1. A head for drums and related percussion instruments incorporating a holographic effect comprising:

a first holographic effect enhancing layer, and a second layer including a holographic effect upon a transparent film substrate, said second layer having a coating upon the surface of the holographic effect comprising a thin layer of metallic particles formed thereon to increase the translucency of said second layer and the reflectivity of light and intensity and variety of colors emanating from the surface of the holographic effect.

2. The head for drums and related percussion instruments according to claim 1 wherein said metallic particles are composed of a metal alloy.

3. The head for drums and related percussion instruments according to claim 2 wherein said metal alloy is aluminum.

4. The head for drums and related percussion instruments according to claim 3 wherein said coating allows approximately 65% transmission therethrough.

5. The head for drums and related percussion instruments according to claim 1 wherein said film substrate is translucent.

6. The head for drums and related percussion instruments according to claim 1 wherein said first holographic effect enhancing layer is generally black in color.

7. The head for drums and related percussion instruments according to claim 1 wherein said film substrate is further defined as having an initial thickness of approximately 0.002 inch to 0.003 inch.

8. The head for drums and related percussion instruments according to claim 7 wherein said film substrate is composed of polyester material.

9. A head for drums and related percussion instruments comprising:

a first holographic effect enhancing layer, a second layer embodying a holographic effect, and a thin coating of metal alloy on said second layer substantially conforming to the contours of the holographic effect therein and deposited on the hologram by the decomposition of the metal alloy in its gaseous form.

10. The head for drums and related percussion instruments according to claim 9 wherein the metal alloy is aluminum.

* * * * *

UNITED STATES PATENT AND TRADEMARK OFFICE

CERTIFICATE OF CORRECTION

PATENT NO. : 4,979,422

DATED : December 25, 1990

INVENTOR(S) : Remo D. BELLI

It is certified that error appears in the above-identified patent and that said Letters Patent is hereby corrected as shown below:

Column 4, line 41, add "light" should read --approximately 65% light transmission therethrough--

Signed and Sealed this

Twenty-sixth Day of May, 1992

*Attest:*

DOUGLAS B. COMER

*Attesting Officer*

*Acting Commissioner of Patents and Trademarks*